US005361543A

United States Patent [19]

Bory

[11] Patent Number: 5,361,543

[45] Date of Patent: Nov. 8, 1994

[54] DEVICE FOR ULTRASONIC EROSION OF A WORKPIECE

[76] Inventor: Michael Bory, Schomattenstrasse 40, 9630 Wattwil, Switzerland

[21] Appl. No.: 118,318

[22] Filed: Sep. 9, 1993

[30] Foreign Application Priority Data

Oct. 1, 1992 [CH] Switzerland ..... 3067/92
Oct. 1, 1992 [CH] Switzerland ..... 3068/92

[51] Int. Cl.[5] ..... B24B 35/00
[52] U.S. Cl. ..... 451/165; 451/155
[58] Field of Search ..... 51/59 SS, 34 H, 34 R, 51/31, 56 R, 317

[56] References Cited

U.S. PATENT DOCUMENTS 2,968,132 1/1961 Hazelton ..... 51/59 SS
3,105,482 10/1963 Mieville ..... 51/59 SS
3,561,462 2/1971 Jugler ..... 51/59 SS
3,614,484 10/1971 Shoh ..... 51/59 SS

FOREIGN PATENT DOCUMENTS 0073272 4/1984 Japan ..... 51/59 SS

*Primary Examiner*—Robert A. Rose
*Attorney, Agent, or Firm*—Shoemaker and Mattare, Ltd.

[57] ABSTRACT

An ultrasonic tool (13) is set into rotational movement to increase the performance of material removal. In addition, a magnetostrictive or piezoelectrical transducer (2) is used, which is coupled to a transformer (7) for amplification of the output amplitude. To lessen the constructional length, transducer and transformer are slid into each other in such a way that their constructional lengths at least partly overlap. Apart from that, transducer and transformer form a rotor which is mounted in non-contact bearings. With a device of this kind, optimal running trueness can be attained.

22 Claims, 3 Drawing Sheets

DEVICE FOR ULTRASONIC EROSION OF A WORKPIECE

Figure 1:
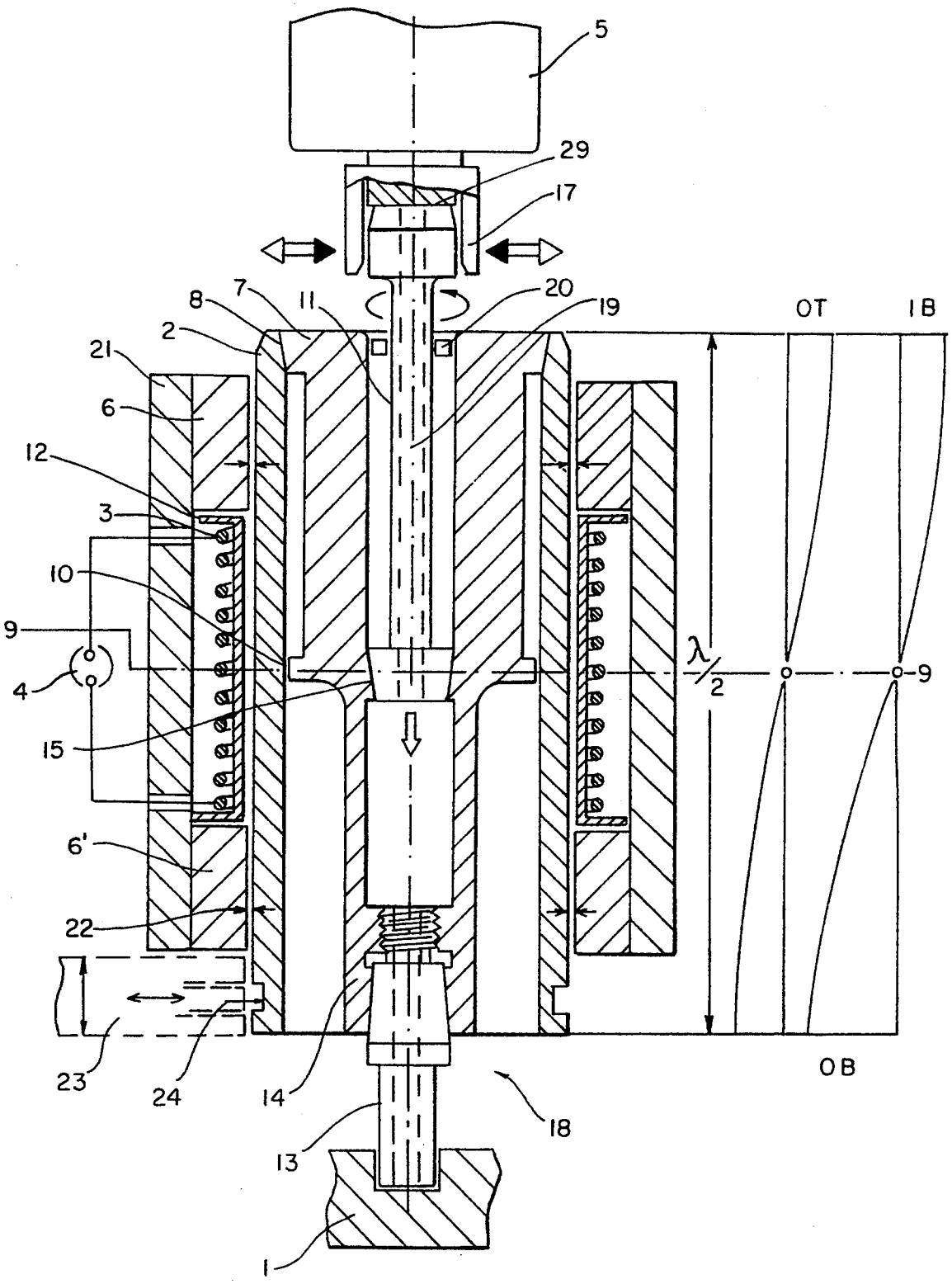

The invention concerns a device for ultrasonic erosion of a workpiece according to the preamble of claim 1. These types of devices are suitable for machining hard and brittle materials such as glass or ceramics. The rotational movement of the tool results in an increase in the performance of material removal, the tool being equipped with a grinding grain, for example of diamond. Alternatively, work can be carried out with a loose grinding grain.

The ultrasonic amplitude attainable with known electroacoustic transformers is too low for machining purposes. For this reason, a mechanical amplitude amplifier is integrated into these devices, with which useful values can be attained. The physical basis of these types of transformers is known to the expert and will therefore not be more closely explained.

With known devices for ultrasonic wave generation, the transformers with the machining tool on the last stage are coupled to the electroacoustic transducer in an axial row, one behind the other. It is known that the length of the coupled components cannot be of any desired length. In order that the entire oscillating system can oscilate in resonance, it is necessary rather to tune each component to the half wave length $\lambda/2$ of the exciting frequency. With numerous transformer stages, this will result in great constructional length, with which rigidity and thus dimensional precision is considerably reduced. With tools which are additionally rotated about their own axis, considerable problems of true running will result.

Additional bearing problems will also result because the oscillating system can only be supported in the oscillation free nodal plane. Finally, known devices give problems when changing the tool, in particularly when tool changing should be automatic. In the case of a faulty acoustic coupling between the tool receptacle and the tool, interference with the machining process can occur.

It is therefore a purpose of the invent ion to create a device of the type mentioned in the introduction, with which the constructional length can be shortened and the rotational properties can be improved, with constant properties in relation to transformation of amplitude. In addition, tool changing should be able to ensue more rapidly and more simply than is possible with known systems. This purpose is solved according to the invention with a device which possesses the features in claim 1.

Through sliding the components within one another, and coupling them at their ends, the total height of the construction can be reduced ideally to $\lambda/2$, also with numerous amplifier steps. With that, not only the mechanical stability will be improved, but chucking of the entire system will be considerably facilitated. Since the nodal points of the separate components can be likewise arranged in a single plane, this presents the possibility of laterally supporting the components together, in the nodal plane. Through designing the components as a rotor mounted in non-contact bearings, the mass moment of inertia and unbalanced mass of the tool spindle can be kept very slight. As a result of this, high rotational speed is possible. Mounting in non-contact bearings causes only slight friction and, apart from that, permits replacement of the rotor, with tool components attached to it, in the simplest way.

The bearings can be hydrostatic, magnetostatic or aerostatic. Non-contact bearings of this type are also employed in other machine tools, and are already known to the expert. When using hydrostatic bearings, the problem of necessary cooling of the oscillator can be simultaneously, optimally solved.

The transducer can be formed as a hollow shaft, and the transformer can be held concentrically in the hollow shaft in such a way that the nodal points of the transducer and the transformer lie approximately in the same plane. On the other hand, the transformer can be formed as a hollow shaft, and the transducer held in the hollow shaft in such a way that the nodal points of the transducer and the transformer lie approximately in the same plane. The transformer and the transducer can here be supported in a simple way on each other, in the plane of their nodal points.

Considerable advantages can be aimed at if, in the case of an external transducer and an internal transformer, the transducer is designed as a magnetostrictive oscillator surrounded by a stationary exciting coil. Current feed to the stationary exciting coil is completely problem free, by means of fixed wiring. Slip rings, necessary for passing current to rotating components, can thus be dispensed with.

The transducer can, however, also be designed as a piezoelectrical oscillator, carrying slip rings in the plane of the nodal points for passing the current.

If a drive shaft engages in the transducer or the transformer approximately in the mutual plane of the nodal points, relatively simple couples can be used with which the longitudinal oscillation can be ignored. In this way, the transformer can for example be formed as a hollow shaft, the means of coupling being arranged on the end of a drive shaft protruding into the transformer. In the same way, the transducer can also be formed as a hollow shaft. The means of coupling can possess a permanent magnet which connects the drive shaft, to be rotationally fixed, with the transducer, respectively with the transformer. Other means of coupling for transmitting rotational movement from the drive device to the tool spindle, respectively to the rotor, would naturally also be conceivable, such as, for example, non-contact magnetic couplings, hydraulic clutches or similar. Transmission of rotational movement by means of a suitable gearbox would also be conceivable.

The rotor is preferably mounted in bearings in such a way that it is able to be extracted at the tool end in an axial direction out of the bearing positions. This has the advantage that the individual tools must no longer be swapped over, since each tool can be equipped with its own rotor. This will solve the problem of the sensitive, acoustic coupling between the tool and the tool holder.

Figure 2:
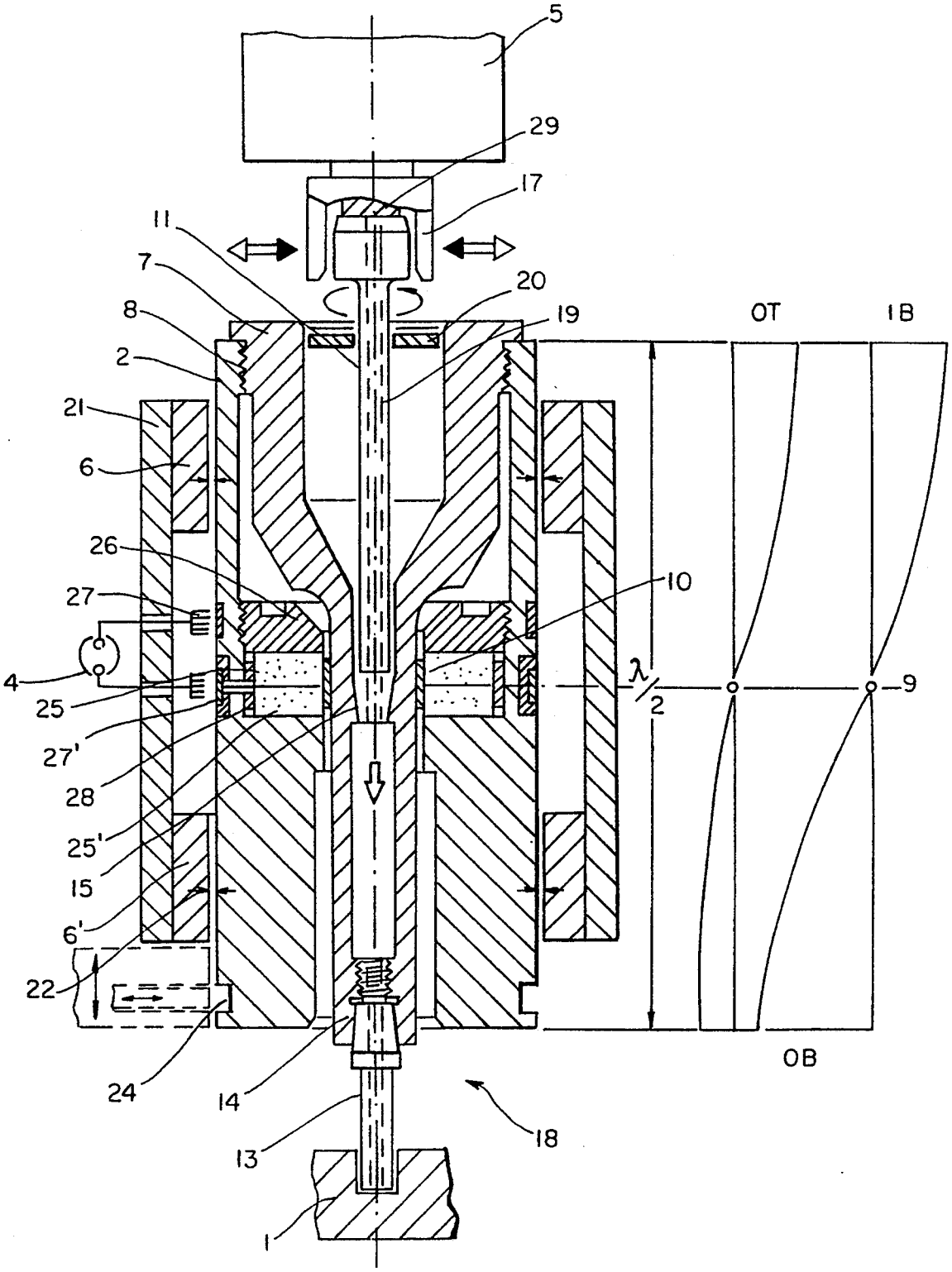
Figure 3:
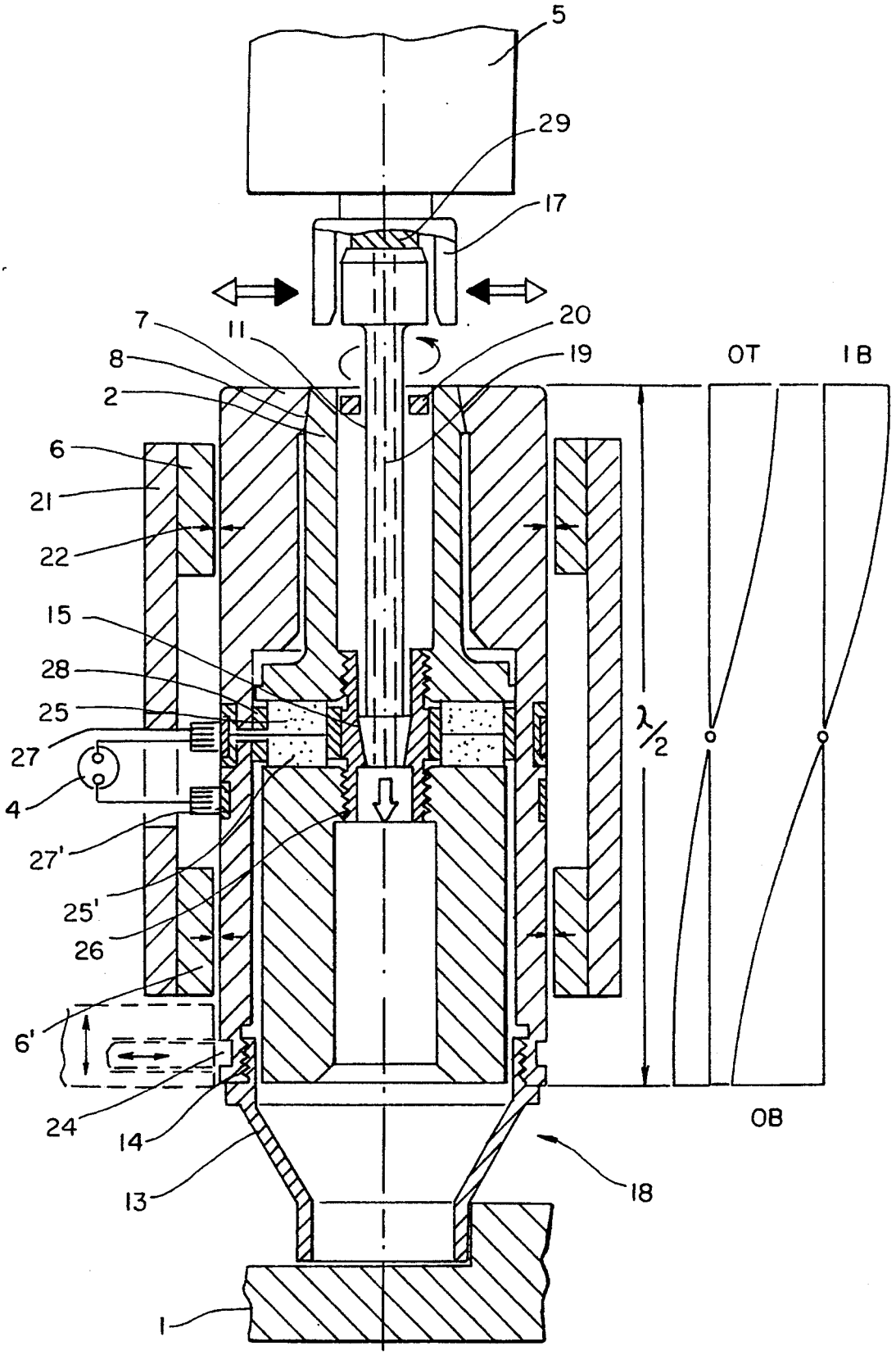

Further individual features of the invention can be seen from the following descriptions of different embodiments and from the drawings. Namely:

FIG. 1 an magnetostrictive oscillator with external transducer and internal transformer, FIG. 2 a piezoelectrical oscillator with external transducer and internal transformer, and FIG. 3 a piezoelectrical oscillator with external transformer and internal transducer.

The machining device according to FIG. 1 comprises a housing 21 in which an exciting coil 3 is arranged on a winding support 12. The exciting coil is connected with a high frequency generator 4. A tube shaped transducer 2 is mounted in bearings in the housing 21, at bearing positions 6 and 6'.

These bearing positions are here only schematically represented. In this case, hydraulic bearings, magnetic bearings or air bearings are concerned which hold the transducer 2 to be able to rotate in the housing 21 and within the exciting coil 3 in such a way, in relation to the stationary components, an annular gap 22 will remain.

The tube shaped transducer 2 comprises a magnetostrictive material, for example nickel. Together with the exciting coil, it forms a magnetostrictive oscillator, with the nodal plane 9, and oscillates with a definite amplitude OT at both its ends, as illustrated in the diagram on the right.

The transducer is coupled at one end, at a coupling point 8, with a transformer 7 which acts as a mechanical oscillation transformer. For this purpose, the material cross section is smaller at the tool end than at the coupling point 8. The input amplitude IB at the upper end of the transformer 7 amplifies itself as a result of the cross sectional reduction down to the output amplitude OB at the tool end of the transformer. On the tool end, a tool holder 14 is intended, which can for example accept a diamond equipped tool 13. Alternatively, the tool end of the transformer 7 could also be designed directly as the tool. A workpiece of a hard material can, for example, be drilled with the aid of the tool 13.

The transformer 7 is itself tube shaped. In the area of its nodal plane 9, there is a fixed or releasable connection 15 with a drive shaft 11 which protrudes into the transformer.

The drive shaft is provided with a channel 19 throughout its entire length through which a rinsing liquid can be pumped to the tool 13.

The drive shaft 11 is releasably connected via a coupling 17 with a drive device 5. A centre support 20 supports the drive shaft 11 during rotor change. The drive device 5 is preferably an electric motor.

Evidently, the transducer 2 and the transformer 7 combined form a rotor 18 which serves as a tool spindle. At the common nodal plane 9, on the one hand the support 10 between the transducer 2 and the transformer 7, and on the other hand the coupling to the drive shaft 11 will ensue. A very advantageous system is achieved in this way with regard to running trueness, with the rotor being able to be easily removed from the housing 21.

At the tool end, the rotor 18 is provided with a surrounding groove 24. On this groove, the tool changer 23 of an automatic changing device can grip and withdraw the rotor from the bearing positions 6, 6'. By this means individual tools are no longer changed, but rather complete tool units which already form a component of the electroacoustic transducer.

With the embodiment according to FIG. 2, the transducer is formed as a piezoelectric oscillator which is excited by both the piezoelectric discs 25, 25'. This transducer is special because the masses oscillating around the nodal plane are not, as is standard, separated by the piezoelectric discs, but are formed integrally. The elastic connection between both the masses is formed by the relatively thin walled part of the transducer in the area of the nodal point plane. Pretensioning of the piezoelectric discs is by means of a banjo nut 26. This embodiment of the transducer permits non-contact mounting in bearings at the bearing positions 6 and 6'. Current feed ensues to the piezoelectric discs via the slip rings 27, 27' lying approximately in the nodal plane 9. In order to increase the output amplitude OT of the transducer 2, a transformer 7 is in turn coupled to the upper end at coupling point 8. By this means, the internal transformer oscillates at the tool end with the output amplitude OB. The tool 13 is fixed to the transformer by the tool holder 14. In order to increase the mechanical stiffness in the nodal plane 9, the transformer is supported by the support 10 on the piezoelectric discs which in turn make contact with the transducer by means of the insulation ring 28.

The rotational drive of the entire rotor 18 is by a drive shaft 11, as with the embodiment according to FIG. 1. The releasable coupling 17 transmits the drive torque, the exact axial position of the rotor being ensured by a limit stop surface 29 after a change of the tool. For tool cooling, the coupling 17 also forms the cooling medium connection to a cooling medium source not shown here. The centering support 20 ensures the coaxial trueness of the drive shaft 11 during the change operation. Change of the entire rotor 18 is the same as with the embodiment according to FIG. 1.

With the embodiment according to FIG. 3, the transducer 2 is likewise formed as a piezoelectric oscillator. As opposed to the embodiment according to FIG. 2, the transducer 2 is here, however, surrounded by the transformer 7. Of necessity, the current feed to the piezoelectric discs 25, 25' is via the slip rings 27, 27' through the transformer 7. The piezoelectic transducer 2 is of a conventional construction, i.e. both the masses on both sides of the piezoelectric discs are completely separated from one another, and are only connected by the threaded tube 26.

Amplitude amplification from the input amplitude IB to output amplitude OB ensues in the same way, naturally the tool 13, respectively the tool holder 14 requiring a somewhat different configuration. As opposed to this, the rotor change is the same as previous embodiments. Likewise identical is the connection of the rotor 18 to the drive device 5.

Naturally, further embodiments built according to the same principle as the invention are conceivable. A magnetostrictive functioning rotor would also be conceivable with which the transformer is arranged externally and the transducer internally. For further amplification of the output amplitude, apart from a first transformer step, a second transformer step could be coupled on. The embodiment according to FIG. 1 is particularly suitable for high speed revolutions, since no slip rings are required. The embodiments according to FIG. 2 and 3 have a somewhat higher degree of effectiveness due to the piezo-technology, but are more suitable for lower speed revolutions. In the case of the embodiments according to FIG. 3, the use of tools with larger diameter, in particular annular shaped tools, is possible without problems.

Inasmuch as the invention is subject to modifications and variations, the foregoing description and accompanying drawings should not be regarded as limiting the invention, which is defined by the following claims and various combinations thereof:

What is claimed is:

1. Device for ultrasonically eroding a work piece (1), said device comprising an electroacoustic transducer (2) for generating ultrasonic oscillations, at least one oscillation amplifier (7) coupled to one end of the transducer for mechanically increasing the amplitude of the transducer and a rotating, driveable tool spindle for holding a tool (13), wherein the transducer is formed as a hollow body and the oscillation amplifier is mounted at least partly within the transducer so that the lengths of the transducer and oscillation amplifier overlap, the transducer and the oscillation amplifier together forming a rotor (18), supported by non-contact bearings (6, 6') surrounding the tool spindle.

2. Device according to claim 1, characterized in that the bearings (6, 6') are hydrostatic bearings.

3. Device according to claim 1, characterized in that the bearings (6, 6') are magnetostatic bearings.

4. Device according to claim 1, characterized in that the bearings (6, 6') are aerostatic bearings.

5. Device according to claim 1, wherein the nodal points of the transducer and of the oscillation amplifier lie approximately in the same plane.

6. Device according to claim 5, characterized in that the oscillation amplifier (7) and the transducer (2) are supported on each other in the plane of their nodal points (9).

7. Device according to claim 5, characterized in that the transducer (2) is formed as a magnetostrictive oscillator surrounded by a stationary exciting coil (3).

8. Device according to claim 5, characterized in that the transducer (2) is formed as a piezoelectric oscillator which carries slip rings (27, 27') in the nodal plane for current feed.

9. Device according to claim 5, wherein the drive shaft (11) engages on the oscillation amplifier approximately in the common nodal plane (9) and forms a releasable connection to a drive device (5).

10. Device according to claim 9, characterized in that the drive shaft (11) is formed as a hollow shaft for feed of a coolant to the tool (13).

11. Device according to claim 1, characterized in that the rotor (18) is able to be withdrawn axially out of the bearings (6, 6').

12. Device for ultrasonically eroding a work piece, said device comprising an electroacoustic transducer for generating ultrasonic oscillations, and at least one oscillation amplifier coupled to one end of the transducer for mechanically transforming the amplitude of the transducer and a rotating, driveable tool spindle for holding a tool, wherein the oscillation amplifier is formed as a hollow body and the transducer is mounted at least partly within the oscillation amplifier so that the lengths of the transducer and oscillation amplifier overlap, the transducer and the oscillation amplifier together forming a rotor supported by non-contact bearings surrounding the tool spindle.

13. Device according to claim 12, wherein the bearings are hydrostatic bearings.

14. Device according to claim 12, wherein the bearings are magnetostatic bearings.

15. Device according to claim 12, wherein the bearings are aerostatic bearings.

16. Device according to claim 12, wherein the nodal points of the transducer and of the oscillation amplifier lie approximately in the same plane.

17. Device according to claim 16, wherein the transducer and the oscillation amplifier are supported one another in the plane of their nodal points.

18. Device according to claim 12, wherein the transducer is formed as a magnetostrictive oscillator surrounded by a stationary exciting coil.

19. Device according to claim 12, wherein the transducer is formed as a piezoelectric oscillator which carries slip rings (27, 27') in the nodal plane for current feed.

20. Device according to claim 12, further comprising a drive shaft engaging the transducer approximately at the common nodal plane, said drive shaft forming a releasable connection to a drive device.

21. Device according to claim 20, wherein the drive shaft is hollow, and feeds coolant to the tool.

22. Device according to claim 12, wherein the rotor can be withdrawn axially out of the bearings.

* * * * *